US005674631A

United States Patent [19]

Feldstein

[11] Patent Number: 5,674,631

[45] Date of Patent: Oct. 7, 1997

[54] SELECTIVE CODEPOSITION OF PARTICULATE MATTER AND COMPOSITE PLATED ARTICLES THEREOF

[75] Inventor: Nathan Feldstein, Princeton, N.J.

[73] Assignee: Surface Technology, Inc., Trenton, N.J.

[21] Appl. No.: 445,401

[22] Filed: May 18, 1995

Related U.S. Application Data

[63] Continuation-in-part of Ser. No. 188,611, Jan. 24, 1994, abandoned, which is a continuation-in-part of Ser. No. 5,680, Jan. 19, 1993, abandoned.

[51] Int. Cl.[6] ..... B32B 5/14

[52] U.S. Cl. ..... 428/610; 428/634; 428/936

[58] Field of Search ..... 428/610, 614, 428/936, 634, 679, 680

[56] References Cited

U.S. PATENT DOCUMENTS

| | | | |
|---|---|---|---|
| 3,467,588 | 9/1969 | Gelbler et al. | 428/614 |
| 3,617,363 | 11/1971 | Metzger et al. | 117/130 |
| 3,723,078 | 3/1973 | Parker | 29/194 |
| 3,936,577 | 2/1976 | Christini et al. | 428/426 |
| 4,358,923 | 11/1982 | Feldstein | 57/401 |
| 4,547,407 | 10/1985 | Spencer | 427/367 |
| 4,588,653 | 5/1986 | Wray | 428/610 |
| 4,817,341 | 4/1989 | Umeda | 205/110 |
| 4,830,889 | 5/1989 | Henry et al. | 427/438 |
| 4,859,494 | 8/1989 | Lancsek | 427/47 |
| 4,900,635 | 2/1990 | Bowen et al. | 428/610 |
| 5,037,513 | 8/1991 | Foster | 204/16 |
| 5,103,637 | 4/1992 | Itoh et al. | 428/614 |
| 5,164,236 | 11/1992 | Schmid | 428/344 |
| 5,326,523 | 7/1994 | Gorynin et al. | 428/610 |

*Primary Examiner*—John Zimmerman

*Attorney, Agent, or Firm*—Lerner, David, Littenberg, Krumholz & Mentlik

[57] ABSTRACT

A process for the selective variation in density of particulate matter codeposited within metallic matrices deposited onto articles utilizing increased levels of rotation of said articles during plating cycle to attain said selective codeposition density. The attainment of varying densities of codeposited particulate matter in the plated layer along the surface of the substrate is particularly useful in cost reduction and improved product performance.

18 Claims, No Drawings

SELECTIVE CODEPOSITION OF PARTICULATE MATTER AND COMPOSITE PLATED ARTICLES THEREOF

REFERENCE TO PRIOR APPLICATION

This application is a continuation-in-part of application Ser. No. 08/188,611 filed Jan. 24, 1994, now abandoned, which is a continuation-in-part of application Ser. No. 005,680 filed on Jan. 19, 1993 now abandoned.

BACKGROUND OF THE INVENTION

The plating of articles with a composite coating bearing finely divided particulate matter is well documented. This technology has been widely practiced in the field of electrolytic plating as well as in the field of electroless plating. The acceptance of these composite coatings stems from the recognition that the inclusion of finely divided particulate matter within metallic matrices can significantly alter the properties of the coating with respect to properties such as wear resistance, corrosion resistance, lubricity, and appearance. Composites derived by electroless plating are a more recent development as compared to electrolytic composite technology.

The state of the art can be reviewed in a recent text entitled "Electroless Plating Fundamentals and Applications," edited by G. Mallory and J. B. Hajdu, Chapter 11, published by the American Electroplaters Society, Orlando, Fla., 1990.

The evolution of composite electroless plating begins with Oderkerken U.S. Pat. No. 3,614,183 in which a structure of composite electroless nickel with finely divided aluminum oxide was interposed between metallic layers for improved corrosion resistance.

Thereafter, Metzget et al in U.S. Pat. Nos. 3,617,363 and 3,753,667 extended the Oderkerken work to a great variety of particles and miscellaneous electroless plating baths. In each of the above cases, the identical condition was maintained throughout each test to achieve a composite layer with finely divided particles uniformly dispersed within the metallic matrices. The aim was to coat the entire part to be plated.

Christini et al in U.S. Pat. No. Re. 33,767 further extended composite electroless plating to the codeposition of diamond particles. In addition, Christini et al demonstrated certain advantages associated with the deposition of a barrier layer (strike) prior to the composite layer. The Christini et al work further relied upon the uniform plating of the articles to be plated with the composite coating.

Yano et al in U.S. Pat. No. 4,666,786 studied the inclusion of silicon carbide along with cubical boron nitride to achieve a better wear and sliding property.

Feldstein in U.S. Pat. Nos. 4,358,922 and 4,358,923 demonstrated the advantages of utilizing an overlayer above the composite layer. The overlayer is essentially free of any particulate matter. The main advantage recognized in these two patents is the ease by which the smoothness of hard composites can be obtained in a short duration of time. Further appreciation of the nickel overlay is more recently noted in U.S. Pat. No. 5,164,236.

Spencer in U.S. Pat. No. 4,547,707 demonstrated the utility of mixtures of dual sized particles in achieving smoothness of a composite coating.

Feldstein et al in U.S. Pat. Nos. 4,997,686, 5,145,517, and 5,300,330 demonstrated the utilization of particulate matter stabilizers in the deposition of a uniform coating including particle codeposition as well as improving stability for composite electroless plating baths.

Parker in U.S. Pat. Nos. 3,562,000 and 3,723,078 demonstrated the codeposition of certain refractory metals and chromium along with composite electroless plating.

Kim in U.S. Pat. No. 4,716,059 disclosed compositions for the codeposition of graphite fluoride, the preferred deposition compositions comprising non-ionic surfactants with specific HLB values.

Henry et al in U.S. Pat. No. 4,830,889 disclosed a process for the codeposition of graphite fluoride comprising the inclusion of a non-ionic fluorocarbon surfactant along with a cationic fluorocarbon surfactant.

Nakamura et al in U.S. Pat. No. 5,232,744 disclosed the use of ammonium sulfate in the codeposition of particulate matter from electroless plating baths.

Herbert et al in U.S. Pat. No. 4,193,253 illustrated the plating of rotors with composite-bearing silicon carbide. A typical cross sectional cut of a rotor is demonstrated.

Lancsek in U.S. Pat. No. 4,859,494 illustrated the appearance of a typical OE combing roll (beater roll).

In these parts the separation between rows of wire or teeth is generally between 1 to 3 mm of separation.

Foster in U.S. Pat. No. 5,037,513 demonstrated a process for composite plated article for achieving a uniform dense codeposition of particles. The process relies upon a plating tank having two zones and the circulation of the solution in each zone occurs in different directions. In addition, the work piece is rotated around multiple axes of rotation. The rotation is also cycled between two intensity levels including a period wherein the rotation of the work piece is ceased.

Although significant work was reported in the above cited patent literature and publications (all included herein by reference) with different objectives and results, there are certain themes common to all of the above references. Specifically, they all demonstrate the practice of identical plating conditions throughout the plating cycle or modification to yield a composite plated article with a uniform cross sectional density of particles dispersed within the metallic matrix. These cross sectional densities are equal or nearly equal throughout all coating surfaces, or planes.

The prior art did not recognize nor suggest any advantages, nor the ability or capability, of depositing composite coatings which one can achieve a selectivity in the percent density of particulate matter codeposited within the metallic matrix along different segments of the article and especially when moving along the plated thickness and in parallel direction to the substrate surface. This invention will demonstrate simple means by which selectivity in the percent of codeposited particulate matter can be achieved along different portions of the substrate's surface. There are many advantages associated with such a capability, ranging from significant cost reductions, particularly with those particulate matter (insoluble particles) which are costly, to the ease of subsequent machining, if required.

SUMMARY OF THE INVENTION

The present invention accomplishes several of the above cited objectives by providing a novel process for the deposition of composite plating bearing finely divided particulate matter dispersed throughout a metallic matrix. The finely divided particulate matter may have any of several characteristics including but not limited to, wear resistance, corrosion resistance, lubricity, and combinations thereof. U.S. Pat. No. 3,617,363 included herein by reference shows many of the particles which can be codeposited.

The present invention provides a method whereby composite coatings can be achieved with selectivity in the percent density of particulate matter codeposited within the metallic matrices along varied portions of the plated substrate. Accordingly, the plated articles will exhibit regions of higher percent density of codeposited particulate matter, as well as regions of lower percent density of codeposited particulate matter when the plated substrate is examined along it's surface, and when comparing cross sectional cuts.

In addition to the significant cost savings achievable with the present method, it is also recognized that lower concentrations of particulate matter can be used in loading the plating bath and thereby further extend and eliminate the burdens associated with loading the plating bath with the insoluble particulate matter. Further advantages of the present invention and method will become apparent to those skilled in the art upon consideration of the following detailed description.

DETAILED DESCRIPTION OF THE INVENTION

A plated composite bearing metallic matrices with finely divided particulate matter dispersed therein is well known in the art. Many studies have focused upon the mechanism of codeposition, particularly in electrodepostion. However, the mechanism for codeposition in electroless composites is not fully understood despite the work reported in the various publications and issued patents. Several parameters may affect the density of codeposited insoluble particulate matter, though no details are provided in the prior art literature. Though I do not wish to be bound by theory, in electroless composites certain parameters such as plating rate (e.g., pH and/or temperature), degree of agitation, and concentration of particles can potentially affect the density of codeposition for specific insoluble particulate matter and a specific plating bath. In all of the prior art the general objective(s) was to yield uniform density of particulate matter throughout the coating and along the deposited layer (thickness).

In the present invention there is a major departure from previous practices. Specifically, the overall composite layer is plated in a manner which will lead to a differential in the percent density of particulate matter codeposited within the metallic matrix along the surface of the substrate rather than along the thickness of the coating. In all the prior art, none of these objective(s) was suggested nor appreciated nor executed, especially using rotational means.

For the purpose of this invention, it should be understood that the expression "along the surface of the substrate" is intended to reflect the observations for the codeposited density in a plane parallel to the surface of the substrate, rather than the examination in a perpendicular mode to the surface of the substrate. That is, the difference in the codeposited density occurs at locations within the thickness of the coating in a direction across the surface of the substrate. Moreover, this expression is not limited to observations(s) at the interface between the substrate and the composite coating or another interface(s).

In the present invention, diamond particles with a mean size of approximately 1.6 microns were used; they were dispersed into a commercial electroless nickel plating bath, NiPLATE 300, sold by Surface Technology, Inc. of Trenton, N.J. The NiPLATE 300 bath is a commercial electroless bath, one of many baths available commercially. It is noted that the present invention is not limited to the type of bath used whether it is an electroless or electrolytic type, nor is this invention limited to the type of metal being plated. The diamond dispersed within the bath was 3.2 grams per 1-liter bath. The bath was maintained at the operating conditions recommended by the manufacturer. In general, a plating cycle of 1.5 hours was used. At the conclusion of the plating cycle, cross sections of the composite coating were examined microscopically at 1,000× to determine the diamond concentration by counting the number of particles in a fixed magnified cross sectional area (½ inch by 1 inch). Rotors were subjected to composite diamond electroless plating using the above bath. The main regions examined for comparison of the rotors were:

1. The center of the rotor's groove (designated position #1).
2. The outside and opposite side of the inner groove (designated position #4).

Comparison of the relative particle count is a good indication of the plating results and a clear demonstration of the present invention.

In all experiments involving rotors the diameter (40 mm) and the grooves were identical. The results (counts) were generally an average of several readings.

EXAMPLE 1

(Control)

At a rotational speed of 1.5 rpm the results were:

Position #1—51 particles counted

Position #4—49 particles counted

EXAMPLE 2

At a rotational speed of 85 rpm the results were:

Position #1—53 particles counted

Position #4—21 particles counted

EXAMPLE 3

At a rotational speed of 168 rpm the results were:

Position #1—43 particles counted

Position #4—None present

Based on the above results, it is evident that the enhanced rotation yields a significant decrease in the particle codeposition along the surface observed at position #4 vs. position #1. From the standpoint of economy and practicality, the critical area on rotors requiring particles codeposition is specifically the area of highest wear, i.e., the groove, or position #1.

EXAMPLES 4 & 5

In these two experiments, slip-on combing roll rings were used. These parts are similar to the parts disclosed in U.S. Pat. Nos. 4,859,494 & 5,164,236. The rings were plated in a standard cycle and thereafter examined by cross sectional magnification at 1000×. The particles were counted (as above) on the leading edge of the wire as well as on the base metal between rows of wire. The area of greatest wear on a slip-on combing roll and therefore the area requiring a coating of highest wear resistance, is the leading edge.

EXAMPLE 4

At a rotational speed of 1.5 rpm the results were:

Leading edge—55 particles counted

Base metal—44 particles counted

EXAMPLE 5

At a rotational speed of 133 rpm the results were:

Leading edge—57 particles counted

Base metal—12 particles counted

EXAMPLE 6

Parts similar to the rotors of Examples 1 through 3 were tested; however, the diamond concentration in the bath was doubled and a rotational speed of 168 rpm was used.

Results were:

Position #1—67 particles counted

Position #4—none present

From the above two examples (#4 & #5), it is noted that the particle count is essentially the same on the leading edge of the wire. These examples further demonstrate that the codeposited diamond on the base metal between the rows of wire decreases dramatically with increased rotational speed. In the present examples though diamond particles were tested, it is obvious to substitute other insoluble particles in the spirit of this invention. It is also noted that the rotation of the articles in this invention was along a single axis.

I claim:

1. A composite electrolessly plated article having a single axis of symmetry, said article comprising a substrate having finely divided insoluble particulate matter dispersed within a metallic coating electrolessly plated thereon, said plated article having a differential percent of particulate matter electrolessly codeposited at different locations having different constructions along the surface of the substrate of said article, said differential percent density being achieved through an increased rotational speed of the substrate during the plating process in comparison to a slower rotational speed necessary for a more uniform electroless codeposition of particulate matter across the surface of the substrate.

2. The article of claim 1, wherein said article is generally cylindrical.

3. The article of claim 1, wherein said substrate has a first geometry along one portion of said surface and a second geometry along another portion of said surface different from said first geometry, wherein the density of said particulate matter within said coating on said surface of said first geometry is different from the density of said particulate matter within said coating on the surface of said second geometry.

4. The article of claim 3, wherein said first geometry comprises a depressed area along the surface of said substrate.

5. The article of claim 3, wherein said second geometry comprises a raised area along the surface of said substrate.

6. A composite electrolessly plated open-end spinning rotor, said rotor comprising a substrate having finely divided insoluble particulate matter dispersed within a metallic coating electrolessly plated thereon, said plated rotor having a differential percent of particulate matter electrolessly codeposited at different locations having different constructions along the surface of the substrate of said rotor, said differential percent density being achieved through an increased rotational speed of the substrate during the plating process in comparison to a slower rotational speed necessary for a more uniform electroless codeposition of particulate matter across the surface of the substrate.

7. The rotor of claim 6, wherein said rotor has a symmetrical axis about which said rotor is rotated.

8. The rotor of claim 6, wherein said substrate has a first geometry along one portion of said surface and a second geometry along another portion of said surface different from said first geometry, wherein the density of said particulate matter within said coating on said surface of said first geometry is different from the density of said particulate matter within said coating on the surface of said second geometry.

9. The rotor of claim 8, wherein said first geometry comprises a depressed area along the surface of said substrate.

10. The rotor of claim 8, wherein said second geometry comprises a raised area along the surface of said substrate.

11. A composite electrolessly plated open-end combing roll, said combing roll comprising a substrate having finely divided insoluble particulate matter dispersed within a metallic coating, said plated combing roll having a differential percent of particulate matter electrolessly codeposited at different locations having different constructions along the surface of the substrate of said combing roll, said differential percent density being achieved through an increased rotational speed of the substrate during the plating process in comparison to a slower rotational speed necessary for a more uniform electroless codeposition of particulate matter across the surface of the substrate.

12. The combing roll of claim 11, wherein said combing roll has a symmetrical axis about which said combing roll is rotated.

13. The combing roll of claim 11, wherein said substrate has a first geometry along one portion of said surface and a second geometry along another portion of said surface different from said first geometry, wherein the density of said particulate matter within said coating on said surface of said first geometry is different from the density of said particulate matter within said coating on the surface of said second geometry.

14. The combing roll of claim 13, wherein said first geometry comprises a depressed area along the surface of said substrate.

15. The combing roll of claim 13, wherein said second geometry comprises a raised area along the surface of said substrate.

16. A composite electrolessly plated article of generally cylindrical shape having a single axis of symmetry, said article comprising a substrate having finely divided insoluble particulate matter dispersed within a metallic coating electrolessly plated thereon, said plated article having a differential percent of particulate matter codeposited at different locations along the surface of the substrate of said article, said substrate having a first geometry of at least one depression along one portion of said surface and a second geometry of at least one raised area along another portion of said surface different from said first geometry, wherein the density of said particulate matter within said coating on said surface of said first geometry is different from the density of said particulate matter within said coating on the surface of said second geometry, said differential percent density being achieved through an increased rotational speed of the substrate during the plating process in comparison to a slower rotational speed necessary for a more uniform electroless codeposition of particulate matter across the surface of the substrate.

17. The article of claim 16, wherein said article comprises an open-end spinning rotor.

18. The article of claim 16, wherein said article comprises an open-end combing roll.

* * * * *